US007845035B2

(12) United States Patent
Letton et al.

(10) Patent No.: US 7,845,035 B2
(45) **Date of Patent: *Dec. 7, 2010**

(54) PRESSURE DISPERSION SUPPORT SYSTEMS

(75) Inventors: Alan Letton, Summerfield, NC (US); Julius Nagy, Kernersville, NC (US); Larry K. DeMoss, Jamestown, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/248,607

(22) Filed: Oct. 9, 2008

(65) Prior Publication Data

US 2009/0089933 A1 Apr. 9, 2009

Related U.S. Application Data

(63) Continuation-in-part of application No. 12/016,374, filed on Jan. 18, 2008, now Pat. No. 7,636,971.

(60) Provisional application No. 60/978,551, filed on Oct. 9, 2007.

(51) Int. Cl.
*A47C 17/00* (2006.01)

(52) U.S. Cl. ..... 5/727; 5/718; 5/740

(58) Field of Classification Search ..... 5/691, 5/718, 727, 730, 731, 736, 740, 655.9
See application file for complete search history.

(56) References Cited

U.S. PATENT DOCUMENTS 3,049,730 A * 8/1962 Wall et al. ..... 297/452.51
3,551,924 A 1/1971 Frye, Sr.
3,846,857 A * 11/1974 Weinstock ..... 5/727
3,885,257 A 5/1975 Rogers
4,639,952 A 2/1987 Kensinger
4,862,538 A 9/1989 Spann et al.
5,081,728 A 1/1992 Skinner
5,136,740 A 8/1992 Kraft
5,148,706 A 9/1992 Masuda et al.
5,469,590 A * 11/1995 Simon ..... 5/721
5,644,811 A * 7/1997 Cavazos ..... 5/738
5,815,865 A 10/1998 Washburn et al.

(Continued)

*Primary Examiner*—Michael Trettel
*Assistant Examiner*—William Kelleher
(74) *Attorney, Agent, or Firm*—Roetzel & Andress

(57) ABSTRACT

A pressure dispersion system includes a pressure dispersion pad and a pressure dispersing mattress system for body support and sleep. The pressure dispersion pad and pressure dispersing mattress systems reduce pressure points from a supported body to less than approximately 32 mm Hg to reduce or eliminate capillary closing and a resultant reduction in pressure concentration and resultant discomfort and repositioning during sleep. Empirical design from human body pressure mapping is used to identify support zones for which components are selected and assembled in the pressure dispersion support systems for pressure dispersion and relief. In a pressure dispersion support system in the form of a mattress, multiple zones are defined by arrangement of different kinds of support materials, including foam tops such as memory foam or moderate to low density polyurethane, and secondary foam layers or foam base of relatively higher density polyurethane and latex. Different types of foam and foam constructs are provided in different zones of the pressure dispersion pad. Incorporation of the pressure dispersion pad in a mattress system, and in combination with foam dampening inserts in an innerspring of the mattress system, translate the pressure relieving properties of the zoned pressure dispersion pad into a mattress system.

19 Claims, 3 Drawing Sheets

U.S. PATENT DOCUMENTS

| | | | | |
|---|---|---|---|---|
| 6,003,179 | A | 12/1999 | Farley | |
| 6,023,803 | A * | 2/2000 | Barman | 5/716 |
| 6,041,459 | A * | 3/2000 | Nunez et al. | 5/730 |
| 6,202,239 | B1 | 3/2001 | Ward et al. | |
| 6,286,166 | B1 | 9/2001 | Henley et al. | |
| 6,430,766 | B1 | 8/2002 | Henley et al. | |
| 6,585,328 | B1 | 7/2003 | Oexman et al. | |
| 6,719,708 | B1 | 4/2004 | Jansen | |
| 6,782,575 | B1 | 8/2004 | Robinson | |
| 6,840,117 | B2 | 1/2005 | Hubbard, Jr. | |
| 6,874,185 | B1 | 4/2005 | Phillips et al. | |
| 7,036,172 | B2 | 5/2006 | Torbet et al. | |
| 7,036,173 | B2 | 5/2006 | Gladney | |
| 7,191,483 | B2 | 3/2007 | Hochschild | |
| 7,293,311 | B2 | 11/2007 | Baker | |
| 7,334,280 | B1 | 2/2008 | Swartzburg | |
| 7,356,863 | B2 | 4/2008 | Oprandi | |
| 7,386,903 | B2 | 6/2008 | Hochschild | |
| 7,636,971 | B2 * | 12/2009 | DeMoss | 5/718 |
| 2003/0009830 | A1 | 1/2003 | Giori et al. | |
| 2003/0135930 | A1 * | 7/2003 | Varese et al. | 5/727 |
| 2004/0074008 | A1 | 4/2004 | Martens et al. | |
| 2005/0210595 | A1 * | 9/2005 | Di Stasio et al. | 5/740 |
| 2006/0042008 | A1 | 3/2006 | Baker | |
| 2007/0022540 | A1 | 2/2007 | Hochschild | |
| 2007/0044245 | A1 | 3/2007 | Bryant et al. | |
| 2007/0113352 | A1 * | 5/2007 | Poulos | 5/727 |
| 2007/0220681 | A1 | 9/2007 | Gladney et al. | |
| 2007/0226911 | A1 * | 10/2007 | Gladney et al. | 5/691 |
| 2008/0115288 | A1 * | 5/2008 | Poulos | 5/727 |
| 2008/0127424 | A1 | 6/2008 | Rawls-Meehan | |
| 2009/0183315 | A1 * | 7/2009 | DeMoss | 5/718 |

* cited by examiner

PRESSURE DISPERSION SUPPORT SYSTEMS

RELATED APPLICATIONS

This application is a conversion of U.S. Provisional Application No. 60/978,551 filed Oct. 9, 2007 and a continuation-in-part of U.S. application Ser. No. 12/016,374 filed Jan. 18, 2008 now U.S. Pat. No. 7,636,971.

FIELD OF THE INVENTION

The present disclosure relates generally to supports for the human body and, more particularly, to pressure-relieving or pressure dispersion supports having different degrees of support corresponding generally to the pressure points exhibited by the human anatomy.

BACKGROUND OF THE INVENTION

Sleep plays an important role in a person's overall health and enjoyment of life. The quality and quantity of sleep we receive each night affects our body's ability to function normally and the ability to reach peak performance. Physiologically, sleep affects our brain activity, heart rate, blood pressure, sympathetic nerve activity, muscle tone, blood flow to the brain, sexual arousal, and body temperature. Sleep deprivation shows a strong correlation to obesity, diabetes, stroke, depression, and hypertension. Restful sleep is dependent upon a persons comfort level while lying prone. The buildup or concentration of pressure on certain parts of the body and poor body alignment are significant causes of restless sleep. Sleeping on a mattress or other support surface that does not properly support and conform to the shape of your body or to the spine's natural curves may significantly contribute to restlessness or inability to sleep. The concept of having a 7-zone mattress or pad was derived from the fact that our bodies have different contours in different places and also different weights. The mattress or pad is fit for each of the seven major areas of the body—head and neck, shoulder and upper back, lumbar, pelvic, knee, lower leg, and foot and ankle. For example, the upper back and pelvis areas are softer, removing pressure points and ensuring better alignment of the spine and the lumbar area is firmer offering more support to the lower back. By reducing the buildup or concentration of pressure on certain points of the body, the 7-zone concept can alleviate restlessness or inability to sleep.

SUMMARY OF THE INVENTION

A pressure dispersion pad and pressure dispersion mattress system includes a base support pad, seven distinct zones or areas of support and three foam inserts. The seven zones are integral and coextensive with each other and extend transversely and are arrayed from the head of the pressure dispersion pad to the foot of the pressure dispersion pad. Four zones are part of the base support pad and three foam inserts are made from latex, visco, NuForm, or a combination thereof, to form an additional three zones. The three foam inserts have a planar top and bottom surface that are placed in three predefined countersunk cut-outs in the base of the support pad. Based on pressure mapping data taken using a human subject lying prone with a BMI in the range of 18-40, the percentage of pressure points between the pressure dispersion pad and the human subject that exceed 30 mm Hg is 23% or less.

In accordance with one aspect of the disclosure and related inventions, a pressure dispersion pad of substantially rectangular shape includes a base support pad, seven distinct zones or areas of support being integral and coextensive with each other and extending transversely and being arrayed from a head of said pressure dispersion pad to a foot of said pressure dispersion pad wherein four zones are part of the base support pad and three foam inserts are made from latex, visco, NuForm, or combinations thereof to form an additional three zones, the three foam inserts having a planar top and bottom surface that are placed in three predefined countersunk cut-outs in the base support pad, wherein, based on pressure mapping data taken using a human subject lying prone with a BMI in the range of 18-40, the percentage of pressure points between the pressure dispersion pad and the human subject that exceed 30 mm Hg is 23% or less.

In accordance with another aspect of the disclosure and related inventions, a pressure dispersing mattress system has an innerspring having a plurality of springs connected together in an array wherein the springs are arranged in rows and columns, each spring having a body with a first end and a second end, the body of each spring being generally cylindrical and having a longitudinal axis and an outer diameter, the springs being spaced apart in the rows and columns and connected together in a spaced apart arrangement with each spring being spaced from each spring in the array; a first layer insulator pad positioned upon a supporting surface formed by the innerspring, a second layer positioned on top of the first layer, the second layer containing at least one polyurethane or latex foam pad, a pressure dispersion pad positioned on top of the second layer, and at least one additional layer positioned on top of the pressure dispersion pad; the pressure dispersion pad comprising a base support pad, seven distinct zones or areas of support being integral and coextensive with each other and extending transversely and being arrayed from a head of said pressure dispersion pad to a foot of said pressure dispersion pad, wherein four zones are part of the base support pad and three foam inserts are made from latex, visco, NuForm, or a combination thereof, to form an additional three zones, the three foam inserts having a planar top and bottom surface that are placed in three predefined countersunk cut-outs in the base support pad; wherein, based on pressure mapping done using a human subject with a BMI between 18-40, the percentage of pressure points between the pressure dispersing mattress system and the human subject that are greater than 30 mm Hg is approximately six percent or less.

These and other aspects of the disclosure and related inventions are herein described in further detail with reference to the accompanying drawing figures.

DETAILED DESCRIPTION OF PREFERRED AND ALTERNATE EMBODIMENTS

The present disclosure relates generally to supports for the human body and, more particularly, to supports having different degrees of support corresponding generally to the pressure points exhibited by the human anatomy. Empirical design from human body pressure mapping is used to identify support zones for which components are selected and assembled in the pressure dispersion support system for pressure dispersion and relief. Pressure points are reduced by both distributing body weight more evenly and dispersing pressure in areas where pressure is concentrated. Generally, blood flows through the capillaries at an approximate pressure of 32 millimeters of mercury (mm Hg). Once the external pressure on a capillary exceeds its internal blood pressure, occlusion occurs and restricts blood flow. Reducing pressure points on the human body that exceed 32 mm Hg reduces the need to shift body position (less tossing and turning) while sleeping to maintain comfort.

Figure 1:
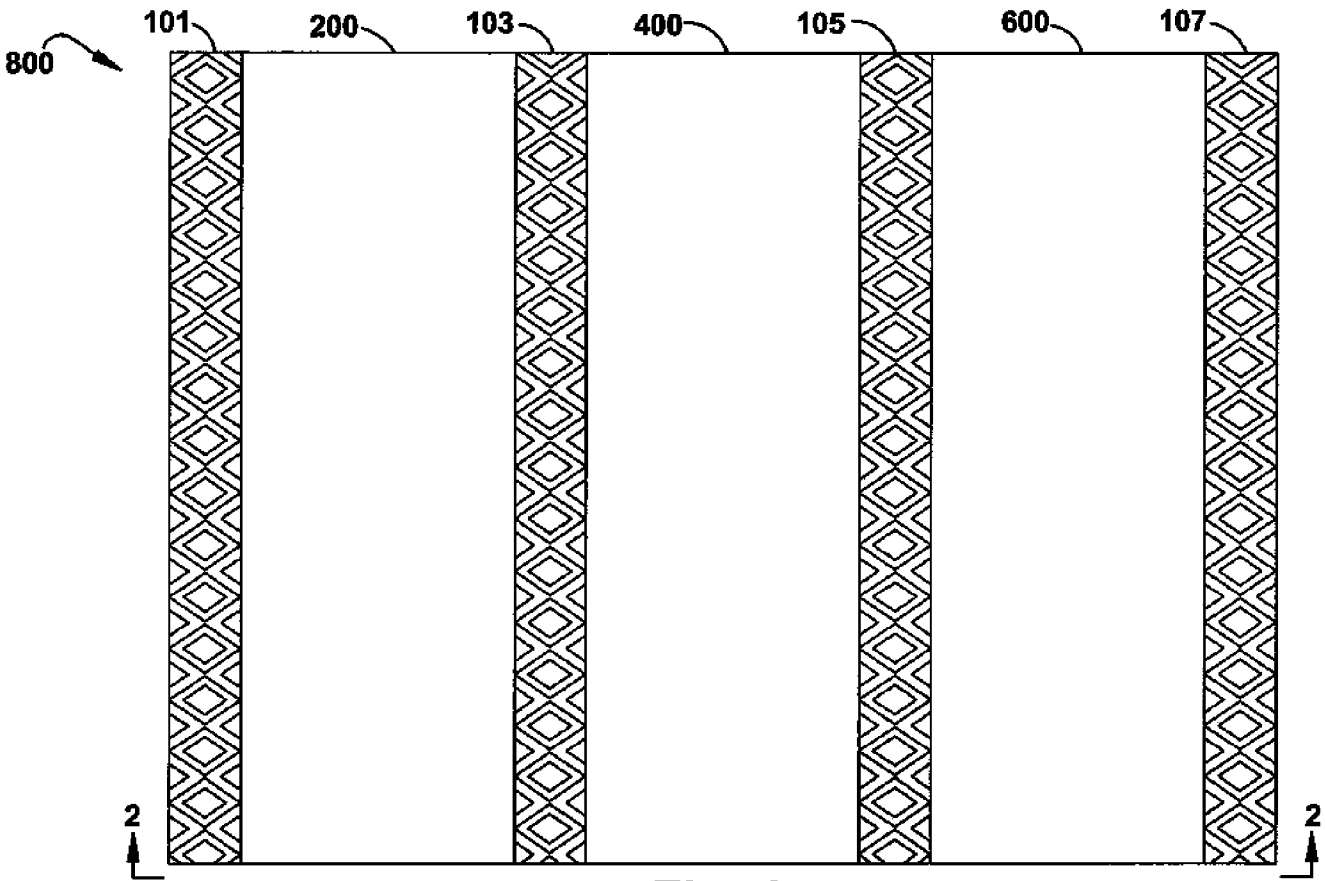
FIG. 1 is a top view of the seven-zoned pressure dispersion pad of the disclosure.

As pictured in FIG. 1, one aspect of the present disclosure is a pressure dispersion pad (hereinafter referred to as "PDP 800") for supporting a human in a prone position, the PDP 800 having seven zones defined by foams of differing types selected and arranged to reduce the number of pressure points exceeding 32 mm Hg. Reduction in pressure points can be demonstrated through pressure mapping measures and easily translated to a "pressure relief index". Pressure mapping is the process of using pressure sensors to determine what areas of the prone body exert the most pressure and therefore require more support to achieve the optimal spinal position. A human test subject lies on a pressure sensitive pad containing several sensors while it is positioned on a support surface. Pressure on each of the individual pressure sensors of the pad is measured and relayed to a computer or other processor which records information. Pressure mapping data was accumulated for several test subjects ranging in body mass index (BMI) from 18-40. The data presented herein is a subset of data collected using a subject in the median range being 5' 8" tall and weighing approximately 166.5 lbs. with a BMI of 27. The testing was performed on a Queen size PDP 800, approximately 60 inches long and 80 inches wide. The measurements obtained are converted into a pressure relief index, which refers to the percentage of contacts made with the sensors that are greater than 30 mm Hg, selected as a design parameter as less than 32 mm Hg.

Figure 2:
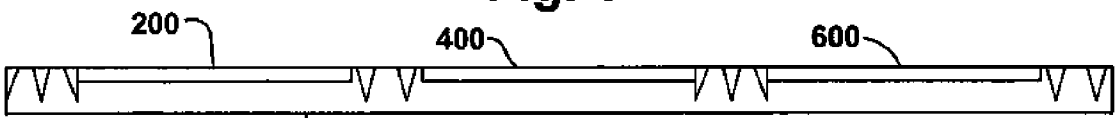
FIG. 2 is a cross-sectional view of the seven-zoned pressure dispersion pad of FIG. 1.

Representative dimensions of the PDP 800 are between 37.5 and 71.5 inches wide and between 74 and 83 inches long. Each of the seven zones was analyzed to determine how each zone is able to manage its own portion of the total body load applied. Zone one 101 is located at the top or the head of the mattress and zone seven 107 at the bottom or the foot of the mattress. There were approximately 10,240 sensors applied to the PDP 800 for testing, each sensor having an area of 0.5 inches by 0.5 inches. Zones one 101, three 103, five 105 and seven 107, where the least amount of body pressure is applied, contain polyurethane foam that is convoluted, sculpted, contoured, or planar and is approximately 2 inches thick. Example widths of zones one 101, three 103, five 105, and seven 107 varies between 2.9 and 7.4 inches. As shown in FIG. 2, the base 100 of the PDP 800 is one slab of polyurethane foam, approximately 2 inches thick. Zones one 101, three 103, five 105, and seven 107 all extend top to bottom as part of the PDP base 100. The base 100 also contains three countersunk cut-outs which are configured to receive inserts which make up zones two 200, four 400, and six 600. Zones two 200 and six 600 are the outer two zones and zone four 400 is the inner zone (as shown in FIG. 1). For each of the three combinations of insert materials used for testing, there were two forms of the underlying base 100 used—one regular and one super soft (SS). The physical/performance properties of the regular base pad are as follows:

| Regular base pad | Units | Specification | Tolerance |
|---|---|---|---|
| Density | lb/cu ft | 1.10 | +/−0.05 |
| Thickness | inches | 2 | +/−0.125 |
| IFD Target @ 25% indention | lb | 28 | +/−4 |
| Compression modulus | — | 1.8 | Min |
| Resilience | % | 40 | N/A |
| Permeability | scfm | 2 | N/A |
| Elongation | % | 100 | Min |
| Tear Strength | lbs/in | 1 | Min |
| Tensile Strength | psi | 10 | Min |
| 90% Compression Set | % | 20 | Max |

The physical/performance properties of the SS base pad are as follows:

| Super Soft (SS) base pad | Units | Specification | Tolerance |
|---|---|---|---|
| Density | lb/cu ft | 1.20 | +/−0.05 |
| Thickness | inches | 2 | +/−0.125 |
| IFD Target @ 25% indention | lb | 14 | +/−3 |
| Compression modulus | — | 1.85 | Min |
| Resilience | % | 40 | N/A |
| Permeability | scfm | 2 | N/A |
| Elongation | % | 150 | Min |
| Tear Strength | lbs/in | 1.25 | Min |
| Tensile Strength | psi | 10 | Min |
| 90% Compression Set | % | 10 | Max |

A variety of support materials were tested to determine the optimal combination of insert materials for zones two 200, four 400, and six 600, where the highest pressure readings are located. The inserts in these zones are approximately 0.5 inches thick and rest upon a 1.5 inch base 100 of polyurethane foam. Representative widths of zones two 200, four 400, and six 600 are between 19 and 19.5 inches wide. Representative materials used for insertion into zones two 200, four 400, and six 600 include Visco/Latex; NuForm/Latex; and Latex/Latex combinations. The materials selected to be inserted into zones two 200, four 400, and six 600 are joined to the base 100 edge to edge with or without a suitable adhesive. The physical/performance properties of the insert materials are as follows:

| Visco Insert | Units | Specification | Tolerance |
|---|---|---|---|
| Density | lb/cu ft | 3 | +/−0.3 |
| Thickness | inches | 0.5 | +/−0.125 |
| IFD Target @ 25% indention | lb | 12 | +/−3 |
| Compression modulus | — | 1.9 | Min |
| Resilience | % | 0 | N/A |
| Permeability | scfm | 0 | N/A |
| Elongation | % | 100 | Min |
| Tear Strength | lbs/in | 0.8 | Min |
| Tensile Strength | psi | 7 | Min |
| Laminate Seam Strength | lbs/in | 0.8 | Min |
| 90% Compression Set | % | 20 | Max |

| Latex Insert | Units | Specification | Tolerance |
|---|---|---|---|
| Density | lb/cu ft | 3.4 | +/−0.2 |
| Thickness | inches | 0.5 | +/−0.125 |
| IFD Target @ 25% indention | lb | 18.5 | +/−2.5 |
| Compression modulus | — | N/A | Min |
| Resilience | % | 26 | N/A |
| Permeability | scfm | N/A | N/A |
| Elongation | % | N/A | Min |
| Tear Strength | lbs/in | N/A | Min |
| Tensile Strength | psi | N/A | Min |
| Laminate Seam Strength | lbs/in | N/A | Min |
| 90% Compression Set | % | 10 | Max |

| NuForm Insert | Units | Specification | Tolerance |
|---|---|---|---|
| Density | lb/cu ft | 3.24 | +/−0.2 |
| Thickness | inches | .5 | +/−0.125 |
| IFD Target @ 25% indention | lb | 22 | +/−3 |
| Compression modulus | — | N/A | Min |
| Resilience | % | 26 | N/A |
| Permeability | scfm | N/A | N/A |
| Elongation | % | N/A | Min |
| Tear Strength | lbs/in | N/A | Min |
| Tensile Strength | psi | N/A | Min |
| Laminate Seam Strength | lbs/in | N/A | Min |
| 90% Compression Set | % | 10 | Max |

Regular Latex/Visco

A first embodiment of the present disclosure is a regular Visco/Latex insert combination pad. Visco is an elastic polyurethane foam commonly referred to as "memory foam". In this embodiment, Visco inserts were used in outer zones two 200 and six 600 and a Latex insert was used in inner zone four 400. The Visco/Latex PDP 800 contains between 84.7%-85.7% of polyurethane foam and between 14.3%-15.3% Latex by weight. The pad has an indentation load deflection (ILD) of 28. ILD is a hardness measurement defined in the ISO 2439 standard. ILD in the standard is defined as the force that is required to compress material a percentage of its original thickness using in the standard a circular plate of 322 $cm^2$. A higher ILD rating means harder foam. A representative collection of the pressure mapping data collected using the regular Visco/Latex insert combination is contained in the following table:

| Visco - Latex - Visco (Regular Base) | Zone 1 | Zone 2 | Zone 3 | Zone 4 | Zone 5 | Zone 6 | Zone 7 | Sum |
|---|---|---|---|---|---|---|---|---|
| Average Pressure | | 24.22 | 18.73 | 25.88 | 14.33 | 14.72 | | |
| Average Max Pressure for Contacts >= 5.00 (mmHg) | 0.00 | 49.58 | 45.13 | 87.60 | 32.03 | 35.79 | 0.00 | |
| Average Number of Contacts >= 5 mmHg | 0 | 439 | 168 | 844 | 165 | 228 | 0 | 1844 |
| Average Number of Contacts <= 20.00 mmHg | 0 | 153 | 100 | 309 | 127 | 163 | 0 | 853 |
| % Average Number of Contacts <= 20.00 mmHg | | 34.91 | 59.90 | 36.59 | 76.78 | 71.53 | | |
| Average Number of Contacts >= 30 mmHg | 0 | 143 | 21 | 255 | 2 | 2 | 0 | 423 |
| % Average Number of Contacts >= 30 mmHg | | 32.54 | 12.77 | 30.20 | 0.97 | 0.70 | | |
| Average Total Load Estimate form XSensor Pad (lbs) | 0.00 | 51.39 | 15.18 | 105.63 | 11.55 | 16.20 | 0.00 | 199.9 |
| Average Ideal Load (lbs) | 0.00 | 42.48 | 16.20 | 81.64 | 15.99 | 22.01 | 0.00 | 178.3 |
| % Average Support (defined by [(Load − Ideal Load)/(Ideal Load) × 100%]) | | 21.09 | −6.33 | 29.38 | −28.33 | −26.42 | | 12.13 |
| Total Load Distribution % | 0.00 | 25.70 | 7.59 | 52.83 | 5.78 | 8.10 | 0.00 | |

SS Visco/Latex

A second embodiment of the present disclosure is an SS Visco/Latex insert combination. In this embodiment, Visco inserts were used in outer zones two 200 and six 600 and a Latex insert was used in inner zone four 400. The SS Visco/Latex PDP 800 contains between 86.8%-87.4% polyurethane foam and between 12.6%-13.2% Latex by weight. The pad has an ILD of 14.

A representative collection of the pressure mapping data collected using the SS Visco/Latex insert combination is contained in the following table:

| Visco - Latex - Visco (SS Base) | Zone 1 | Zone 2 | Zone 3 | Zone 4 | Zone 5 | Zone 6 | Zone 7 | Sum |
|---|---|---|---|---|---|---|---|---|
| Average Pressure | | 20.71 | 18.73 | 22.71 | 15.06 | 13.41 | 7.91 | |
| Average Max Pressure for Contacts >= 5.00 (mmHg) | 0 | 43.03 | 59.43 | 86.51 | 32.27 | 25.30 | 11.12 | |
| Average Number of Contacts >= 5 mmHg | 0 | 367 | 213 | 891 | 250 | 304 | 8 | 2033 |
| Average Number of Contacts <= 20.00 mmHg | 0 | 167 | 137 | 478 | 190 | 265 | 8 | 1246 |
| % Average Number of Contacts <= 20.00 mmHg | | 45.53 | 64.29 | 53.66 | 76.22 | 87.19 | 100.00 | |
| Average Number of Contacts >= 30 mmHg | 0 | 51 | 31 | 198 | 2 | 0 | 0 | 282 |
| % Average Number of Contacts >= 30 mmHg | | 13.96 | 14.53 | 22.18 | 0.96 | 0.00 | 0.00 | |
| Average Total Load Estimate form XSensor Pad (lbs) | 0.00 | 36.73 | 19.31 | 97.79 | 18.25 | 19.73 | 0.32 | 192.14 |
| Average Ideal Load (lbs) | 0.00 | 35.46 | 20.63 | 86.13 | 24.15 | 29.43 | 0.75 | 196.56 |
| % Average Support (defined by [(Load − Ideal Load)/(Ideal Load) × 100%]) | | 3.55 | −6.37 | 13.53 | −24.68 | −32.95 | −60.45 | −2.25 |
| Total Load Distribution % | 0.00 | 19.12 | 10.05 | 50.90 | 9.50 | 10.27 | 0.17 | |

Regular Latex/NuForm

A third embodiment of the present disclosure is a regular Latex/NuForm insert combination. In this embodiment, NuForm inserts were used in outer zones two 200 and six 600 and a Latex insert was used in inner zone four 400. NuForm is a superior variety of latex foam that consists of 100% Talalay latex. Talalay refers to the method by which latex is manufactured. In the Talalay method, air is extracted from the latex foam and the latex is flash frozen, resulting in an "airier" latex. The Latex/NuForm PDP 800 used in this embodiment contains approximately 57.4% polyurethane foam and 42.6% Latex by weight. The NuForm has an ILD of 22 and the Latex has an ILD of 18. A representative collection of the pressure mapping data collected using the regular Latex/NuForm insert combination is contained in the following table:

| NuForm - Latex - NuForm (Regular Base) | Zone 1 | Zone 2 | Zone 3 | Zone 4 | Zone 5 | Zone 6 | Zone 7 | Sum |
|---|---|---|---|---|---|---|---|---|
| Average Pressure | | 23.05 | 18.80 | 23.97 | 14.49 | 15.35 | | |
| Average Max Pressure for Contacts >= 5.00 (mmHg) | 0.00 | 41.19 | 46.24 | 95.83 | 29.94 | 25.61 | 14.62 | |
| Average Number of Contacts >= 5 mmHg | 0 | 299 | 174 | 738 | 189 | 252 | 7 | 1659 |
| Average Number of Contacts <= 20.00 mmHg | 0 | 106 | 106 | 326 | 146 | 197 | 7 | 887 |
| % Average Number of Contacts <= 20.00 mmHg | | 35.45 | 60.94 | 44.22 | 76.96 | 78.11 | 97.14 | |
| Average Number of Contacts >= 30 mmHg | 0 | 79 | 26 | 161 | 2 | 0 | 0 | 268 |
| % Average Number of Contacts >= 30 mmHg | | 26.49 | 14.75 | 21.85 | 0.85 | 0.08 | 0.00 | |
| Average Total Load Estimate form XSensor Pad (lbs) | 0.00 | 33.31 | 15.81 | 85.41 | 13.30 | 18.75 | 0.33 | 166.92 |
| Average Ideal Load (lbs) | 0.00 | 28.91 | 16.78 | 71.31 | 18.29 | 24.38 | 0.68 | 160.36 |
| % Average Support (defined by [(Load − Ideal Load)/(Ideal Load) × 100%]) | | 15.24 | −6.02 | 19.83 | −27.57 | −23.27 | 4.09 | |
| Total Load Distribution % | 0.00 | 19.95 | 9.47 | 51.17 | 7.97 | 11.23 | 0.20 | |

SS Latex/NuForm

A fourth embodiment of the present disclosure is a SS Latex/NuForm insert combination. In this embodiment, NuForm inserts were used in outer zones two 200 and six 600 and a Latex insert was used in inner zone four 400. The SS Latex/NuForm PDP 800 used in this embodiment contain approximately 62.3% polyurethane foam and 37.7% Latex by weight. The NuForm has an ILD of 22 and the Latex has an ILD of 18. A representative collection of the pressure mapping data collected using the SS Latex/NuForm insert combination is contained in the following table:

| NuForm - Latex - NuForm (SS Base) | Zone 1 | Zone 2 | Zone 3 | Zone 4 | Zone 5 | Zone 6 | Zone 7 | Sum |
|---|---|---|---|---|---|---|---|---|
| Average Pressure | | 20.82 | 20.09 | 23.65 | 15.37 | 14.06 | 8.98 | |
| Average Max Pressure for Contacts >= 5.00 (mmHg) | 0.00 | 43.06 | 65.94 | 105.24 | 37.48 | 28.86 | 17.20 | |
| Average Number of Contacts >= 5 mmHg | 0 | 312 | 191 | 783 | 254 | 319 | 13 | 1871 |
| Average Number of Contacts <= 20.00 mmHg | 0 | 141 | 116 | 448 | 191 | 273 | 12 | 1181 |
| % Average Number of Contacts <= 20.00 mmHg | | 45.19 | 60.65 | 57.19 | 75.06 | 85.59 | 98.41 | |
| Average Number of Contacts >= 30 mmHg | 0 | 41 | 41 | 192 | 8 | 4 | 0 | 285 |
| % Average Number of Contacts >= 30 mmHg | | 13.09 | 21.30 | 24.52 | 3.15 | 1.13 | 0.00 | |
| Average Total Load Estimate form XSensor Pad (lbs) | 0.00 | 31.34 | 18.50 | 89.48 | 18.89 | 21.60 | 0.56 | 180.37 |
| Average Ideal Load (lbs) | 0.00 | 30.13 | 18.43 | 75.70 | 24.58 | 30.86 | 1.22 | 180.92 |
| % Average Support (defined by [(Load − Ideal Load)/(Ideal Load) × 100%]) | | 4.08 | 0.46 | 18.25 | −23.13 | −29.69 | −55.08 | −0.30 |
| Total Load Distribution % | 0.00 | 17.37 | 10.26 | 49.61 | 10.47 | 11.98 | 0.31 | |

Regular Latex/Latex

A fifth embodiment of the present disclosure is a regular Latex/Latex insert combination. In this embodiment, Soft Latex inserts were used in outer zones two 200, six 600 and Extra Soft Latex was used in inner zone four 400. The Latex/Latex PUP 800 used in this embodiment contains approximately 55.5% polyurethane foam and 45% Latex by weight. The Soft Latex has an ILD of 22 and the Extra Soft Latex has an ILD of 18. A representative collection of the pressure mapping data collected using the regular Latex/Latex insert combination is contained in the following table:

| Latex - Latex - Latex (Regular Base) | Zone 1 | Zone 2 | Zone 3 | Zone 4 | Zone 5 | Zone 6 | Zone 7 | Sum |
|---|---|---|---|---|---|---|---|---|
| Average Pressure | | 22.41 | 17.16 | 24.16 | 16.28 | 16.25 | | |
| Average Max Pressure for Contacts >= 5.00 (mmHg) | 0.00 | 41.42 | 46.40 | 85.61 | 39.70 | 28.78 | 14.51 | |
| Average Number of Contacts >= 5 mmHg | 0 | 257 | 180 | 767 | 258 | 277 | 10 | 1749 |
| Average Number of Contacts <= 20.00 mmHg | 0 | 99 | 118 | 317 | 179 | 196 | 10 | 918 |
| % Average Number of Contacts <= 20.00 mmHg | | 38.44 | 65.33 | 41.33 | 69.64 | 70.58 | 96.00 | |
| Average Number of Contacts >= 30 mmHg | 0 | 54 | 19 | 199 | 12 | 1 | 0 | 285 |
| % Average Number of Contacts >= 30 mmHg | | 21.01 | 10.44 | 25.96 | 4.74 | 0.22 | 0.00 | |
| Average Total Load Estimate form XSensor Pad (lbs) | 0.00 | 27.68 | 14.92 | 89.46 | 20.30 | 21.71 | 0.53 | 174.62 |
| Average Ideal Load (lbs) | 0.00 | 24.85 | 17.40 | 74.20 | 24.91 | 26.82 | 0.97 | 169.14 |
| % Average Support (defined by [(Load − Ideal Load)/(Ideal Load) × 100%]) | | 12.03 | −14.18 | 20.78 | −18.62 | −18.74 | | 3.24 |
| Total Load Distribution % | 0.00 | 15.85 | 8.55 | 51.23 | 11.63 | 12.43 | 0.30 | |

SS Latex/Latex

A sixth embodiment of the present disclosure is a SS Latex/Latex insert combination. The Latex/Latex PDP 800 used in this embodiment contains approximately 60.2% polyurethane foam and 39.8% Latex by weight. The Soft Latex has an ILD of 22 and the Extra Soft Latex has an ILD of 18. A representative collection of the pressure mapping data collected using the SS Latex/Latex insert combination is contained in the following table:

| Latex - Latex - Latex (SS Base) | Zone 1 | Zone 2 | Zone 3 | Zone 4 | Zone 5 | Zone 6 | Zone 7 | Sum |
|---|---|---|---|---|---|---|---|---|
| Average Pressure | | 19.81 | 17.54 | 23.14 | 17.30 | 13.65 | | |
| Average Max Pressure for Contacts >= 5.00 (mmHg) | 0.00 | 50.32 | 59.29 | 108.12 | 56.19 | 33.52 | 19.29 | |
| Average Number of Contacts >= 5 mmHg | 0 | 325 | 196 | 815 | 291 | 396 | 17 | 2039 |
| Average Number of Contacts <= 20.00 mmHg | 0 | 158 | 136 | 454 | 201 | 330 | 16 | 1294 |
| % Average Number of Contacts <= 20.00 mmHg | | 48.55 | 69.25 | 55.69 | 69.05 | 83.32 | 94.12 | |
| Average Number of Contacts >= 30 mmHg | 0 | 33 | 29 | 189 | 24 | 5 | 0 | 280 |
| % Average Number of Contacts >= 30 mmHg | | 10.04 | 14.81 | 23.23 | 8.18 | 1.21 | 0.00 | |
| Average Total Load Estimate form XSensor Pad (lbs) | 0.00 | 31.11 | 16.74 | 91.36 | 24.27 | 26.39 | 0.81 | 190.69 |
| Average Ideal Load (lbs) | 0.00 | 31.38 | 18.93 | 78.82 | 28.12 | 38.25 | 1.64 | 197.14 |
| % Average Support (defined by [(Load − Ideal Load)/(Ideal Load) × 100%]) | | −.95 | −12.29 | 15.72 | −13.49 | −31.75 | −49.64 | −3.27 |
| Total Load Distribution % | 0.00 | 16.31 | 8.78 | 47.91 | 12.73 | 13.84 | 0.43 | |

Pressure mapping results for the various PDP material combinations are summarized in the table below:

| Test Pad | Average Contact Area | Average Contact >30 mmHg | Pressure Relief Index |
|---|---|---|---|
| Regular Visco/Latex | 1844 | 422 | 0.229123816 |
| SS Visco/Latex | 2033 | 282 | 0.138829592 |
| Regular Latex/NuForm | 1658 | 267 | 0.161506073 |
| SS Latex/Nuform | 1871 | 285 | 0.152207857 |
| Regular Latex/Latex | 1749 | 284 | 0.163311174 |
| SS Latex/Latex | 2039 | 279 | 0.137106016 |

As the data indicates, each of the embodiments of the PDP, have a pressure relief index of less than 23. Particularly, the SS Latex/Latex and SS Visco/Latex PDPs have the lowest percentages of contacts above 30 mm Hg, each having approximately 13% of contacts above 30 mm Hg.

Figure 3:
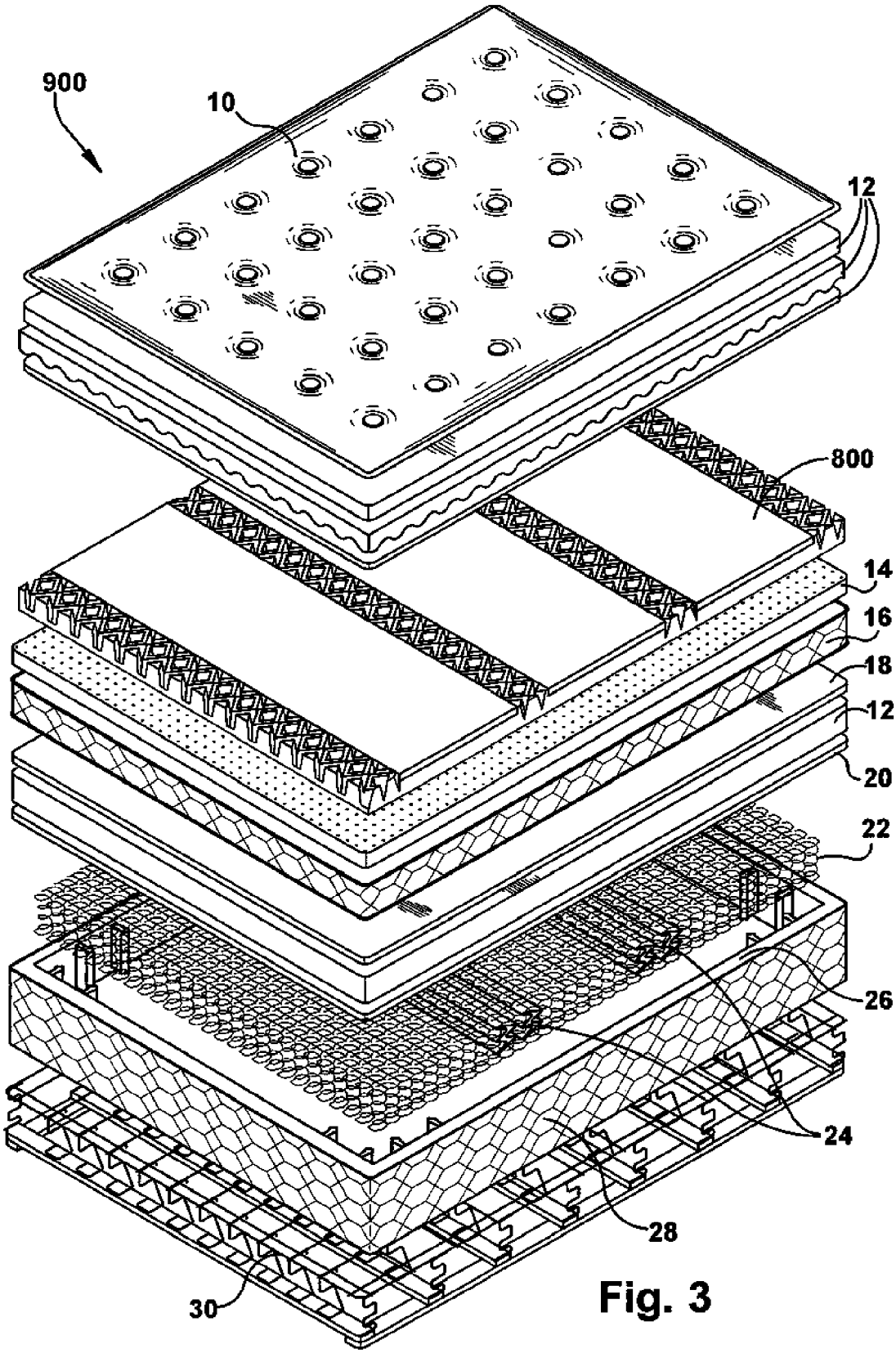
FIG. 3 is a perspective exploded view of a mattress of the disclosure.

As shown in FIG. 3, a further embodiment and aspect of the present disclosure is use of any of the PDPs 800 in a mattress system 900. The mattress system 900 includes the PDP 800 in combination with several layers of material including padding, compressible support layers or exterior upholstery such as: mattress ticking 10; polyurethane or latex foam 12, 14; a mattress pillow top 16; convolute 18; an insulator pad 20; an edge support made of extruded foam 26; and a mattress border 28. A box spring 30 also referred to as a "foundation", can be used as a base for the mattress system 900. The mattress system 900 also includes a spring system, called the "innerspring" 22 which can be in one form a plurality of similarly or identically formed springs which are interconnected in an array or matrix. The innerspring 22 provides a distributed generally homogenous reflexive support system to give underlying support to an expanse such as the sleep surface of a mattress. In the present disclosure, there are between 672-736 coils (or springs) in the innerspring 22 although other types of innersprings with different coil counts can be used in the mattress system 900. A solid foam core, such as latex, can be used in place of an innerspring.

Figure 4:
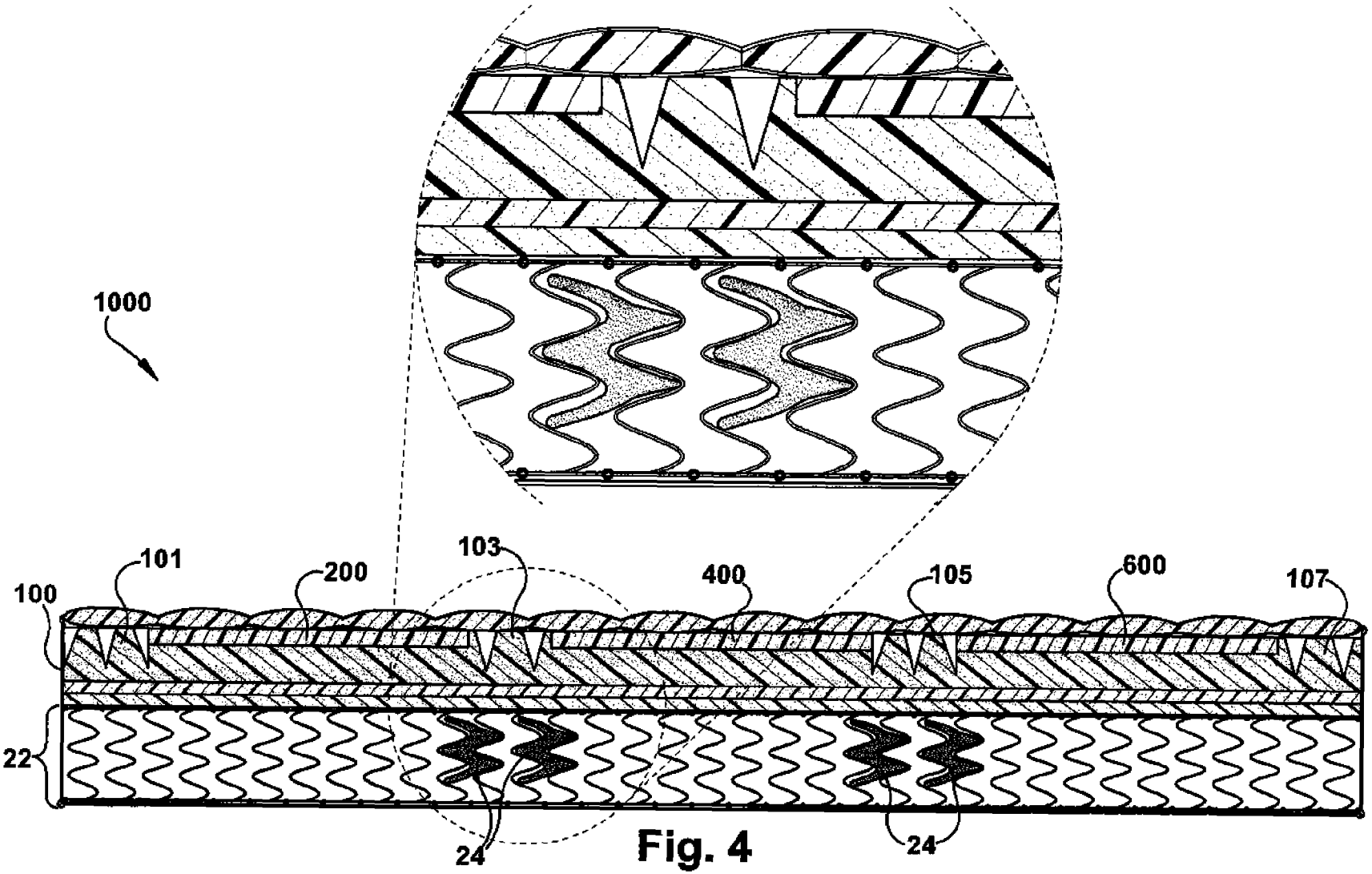
FIG. 4 is a cross-sectional view of a mattress showing the placement of dampening inserts in an innerspring beneath the pressure dispersion pad.

Also, in one embodiment there is provided a foam dampened innerspring which includes an innerspring 22 formed by a plurality of springs connected together in an array wherein the springs are arranged in rows and columns, each spring having a body with a first end and a second end, the body of each spring being generally cylindrical and having a longitudinal axis and an outer diameter, the springs being generally cylindrical and having a longitudinal axis and an outer diameter, the springs being spaced apart in the rows and columns and connected together in a spaced apart arrangement with each spring being spaced from each adjacent spring in the array; at least one foam dampening insert 24 located in the innerspring 22 in spaces between springs of the innerspring 22, the foam dampening insert 24 having a central core which fits between the bodies of adjacent springs, and a first segment which extends from the central core and into an opening region of a first spring to at least partially intersect a longitudinal axis of the first spring, and a second segment which extends. from the central core and into an opening region of a second spring which is adjacent to the first spring and to at least partially intersect a longitudinal axis of the second spring. As shown in FIG. 4, in the present disclosure, the foam dampening inserts 24 are preferably placed directly below the seam between zones two 200 and three 103, zones three 103 and four 400, zones four 400 and five 105, and zones five 105 and six 600. The mechanical engagement of the innerspring 22 by the foam dampening inserts 24 in the critical locations between zones containing foam inserts (two 200, four 400, and six 600) and convolute (three 103 and five 105) insures the proper transition between zones having different support characteristics. Because the foam dampening insert 24 has a spring rate which may be different than that of the coils or less than an aggregate spring rate of the innerspring 22, the foam dampening insert 24 thus acts as a dampener to reduce the overall spring rate of the innerspring 22 and mattress 900, in the region or zone where the insert 24 is installed in the innerspring 22, and relative to the underlying PDP 800. In the mattress system 900, the foam dampening inserts 24 can alternatively be placed in other locations and other orientations, as described in the co-pending application, U.S. Ser. No. 12/016,374, filed Jan. 18, 2008.

Pressure mapping data was collected using the entire mattress assembly integrated with the PDP 800, as described above. The testing was performed using the inserts made of Visco/Latex with a super soft base pad (described above). A representative collection of the pressure mapping data collected is contained in the following table:

| Entire Mattress Assembly (Pillow top w/PDP) | Zone 1 | Zone 2 | Zone 3 | Zone 4 | Zone 5 | Zone 6 | Zone 7 | Sum |
|---|---|---|---|---|---|---|---|---|
| Average Pressure | | 8.62 | 7.04 | 15.93 | 11.18 | 15.05 | | |
| Average Min Pressure for Contacts >= 5.00 (mmHg) | 0.00 | 5.01 | 5.00 | 5.01 | 5.14 | 5.01 | 1.67 | |
| Average Max Pressure for Contacts >= 5.00 (mmHg) | 0.00 | 18.34 | 11.73 | 41.07 | 18.93 | 52.98 | 9.54 | |
| Average Number of Contacts >= 5 mmHg | 0 | 182 | 77 | 961 | 205 | 630 | 13 | 2067 |
| Average Number of Contacts <= 20.00 mmHg | 0 | 182 | 77 | 685 | 205 | 484 | 12 | 1645 |
| % Average Number of Contacts <= 20.00 mmHg | 100.00 | 100.00 | 71.27 | 99.84 | 76.88 | 94.74 | | |
| Average Number of Contacts >= 30 mmHg | 0 | 0 | 0 | 40 | 0 | 44 | 0 | 84 |
| % Average Number of Contacts >= 30 mmHg | | 0.00 | 0.00 | 4.20 | 0.00 | 6.98 | 0.00 | |
| Average Total Load Estimate form XSensor Pad (lbs) | 0.00 | 7.58 | 2.63 | 74.00 | 11.09 | 45.90 | 0.57 | 141.77 |
| Average Ideal Load (lbs) | 0.00 | 17.56 | 7.44 | 92.88 | 19.85 | 60.91 | 1.22 | 199.88 |
| % Average Support (defined by [(Load − Ideal Load)/(Ideal Load) × 100%]) | | −56.90 | −64.79 | −20.33 | −44.09 | −24.75 | | −29.07 |
| Total Load Distribution % | 0.00 | 5.34 | 1.86 | 52.20 | 7.82 | 32.38 | 0.40 | |

Pressure mapping data was also collected for another representative embodiment of the present disclosure, a mattress system 1000 with the PDP 800 but without a separate and distinct pillow top, as shown for example in FIG. 4. A representative collection of the data collected for this embodiment is as follows:

| Entire Mattress Assembly (Non-Pillow top w/PDP) | Zone 1 | Zone 2 | Zone 3 | Zone 4 | Zone 5 | Zone 6 | Zone 7 | Sum |
|---|---|---|---|---|---|---|---|---|
| Average Pressure | | 8.47 | 8.29 | 16.70 | 13.36 | 15.22 | | |
| Average Min Pressure for Contacts >= 5.00 (mmHg) | 0.00 | 5.04 | 5.02 | 5.01 | 5.09 | 5.01 | 8.98 | |
| Average Max Pressure for Contacts >= 5.00 (mmHg) | 0.00 | 21.41 | 12.87 | 42.68 | 22.14 | 46.82 | 18.99 | |
| Average Number of Contacts >= 5 mmHg | 0 | 150 | 99 | 975 | 204 | 687 | 6 | 2121 |
| Average Number of Contacts <= 20.00 mmHg | 0 | 149 | 99 | 659 | 197 | 528 | 5 | 1638 |
| % Average Number of Contacts <= 20.00 mmHg | | 99.56 | 100.00 | 67.57 | 96.73 | 76.94 | 88.89 | |
| Average Number of Contacts >= 30 mmHg | 0 | 0 | 0 | 69 | 0 | 42 | 0 | 112 |
| % Average Number of Contacts >= 30 mmHg | | 0.00 | 0.00 | 7.11 | 0.00 | 6.17 | 5.56 | |
| Average Total Load Estimate form XSensor Pad (lbs) | 0.00 | 6.17 | 3.98 | 78.75 | 13.16 | 50.65 | 0.32 | 153.0 |
| Avenge Ideal Load (lbs) | 0.00 | 14.50 | 9.54 | 94.30 | 19.72 | 66.39 | 0.58 | 205.0 |
| % Average Support (defined by [(Load − Ideal Load)/(Ideal Load) × 100%]) | | −57.64 | −58.56 | −16.48 | −33.22 | −23.91 | | −25.36 |
| Total Load Distribution % | 0.00 | 4.03 | 2.60 | 51.46 | 8.60 | 33.10 | 0.21 | |

Pressure mapping results for the two mattress system embodiments are summarized in the table below:

| Test Pad | Average Contact Area | Average Contact >30 mmHg | Pressure Relief Index |
|---|---|---|---|
| Pillow-top mattress | 2067 | 84 | 0.04064771 |
| Tight-top mattress (non-pillow-top) | 2120 | 112 | 0.052611 |

As indicated by the data, both of the described mattress systems 900, 1000 with a PDP 800 have a pressure relief index of less than six percent. This data confirms that the PDP 800 as incorporated into the mattress systems 900, 1000 and the mattress systems 900, 1000 as a whole, are highly effective at reducing pressure and concentrations of pressure on a body in a prone position on the mattresses.

What is claimed as the invention is:

1. A pressure dispersing mattress system comprised of:

an innerspring having a plurality of coils interconnected in an array of columns and rows, the columns of coils being generally equally spaced apart, and the rows of coils being generally equally spaced apart, each coil having a generally helical wire form body with openings between helical turns of wire of the helical wire form body;

a base support pad, having seven distinct zones or areas of support being integral and coextensive with each other and extending transversely and being arrayed from a head of said pressure dispersion pad to a foot of said pressure dispersion pad wherein four zones are part of the base support pad and three foam inserts are made from latex, visco, NuForm, or combinations thereof to form an additional three zones, the three foam inserts having a planar top and bottom surface that are placed in three predefined countersunk cut-outs in the base support pad, at least one foam dampening insert located in the innerspring between coils of the array, the at least one foam dampening insert having a central core which fits in a space between a row or column of coils of the array, and at least five segments which extend laterally from the central core and into one or more openings between the helical turns of wire of the helical wire form bodies of at least two adjacent coils of the array the at least five segments having three segments that extend in a first direction from the central core and into an opening region of a first spring to at least partially intersect a longitudinal axis of the first spring and two segments that extend in a second direction from the central core and into an opening region of a second spring which is adjacent to the first spring and to at least partially intersect a longitudinal axis of the second spring, each of the at least five segments being located at a different elevation than every other segment.

2. The pressure dispersing mattress system of claim 1, wherein the three foam inserts are approximately 0.5 inches thick and are placed adjacent to zones comprised of convolute polyurethane foam.

3. The pressure dispersing mattress system of claim 1, wherein the base support pad is made of polyurethane foam having a density of approximately 1.10 lb/cu ft and an ILD rate of approximately 28 and being approximately 2 inches thick.

4. The pressure dispersing mattress system of claim 3, wherein two of the outer foam inserts are comprised of visco and one inner foam insert is comprised of latex, the pressure dispersion pad comprising approximately 85% of polyurethane foam and between approximately 15% latex by weight

5. The pressure dispersing mattress system of claim 3, wherein two of the outer foam inserts are comprised of NuForm and one inner foam insert is comprised of latex, the pressure dispersion pad being comprised of approximately 57.4% polyurethane foam and approximately 42.6% latex by weight.

6. The pressure dispersing mattress system of claim 3, wherein two of the outer foam inserts are comprised of soft latex and one inner foam insert is comprised of extra soft latex, the entire pad being comprised of approximately 55% polyurethane foam and 45% latex by weight.

7. The pressure dispersing mattress system of claim 1, wherein the 2-inch base support pad is comprised of polyurethane foam having a density of approximately 1.20 lb/cu ft and an ILD rate of approximately 14.

8. The pressure dispersing mattress system of claim 7, wherein two of the outer foam inserts are comprised of visco and one inner foam insert is comprised of latex, the entire pad comprising between 84.7 - 85.7% of polyurethane foam and between 14.3 - 15.3% latex by weight.

9. The pressure dispersing mattress system of claim 7, wherein two of the outer foam inserts are comprised of NuForm and one inner foam insert is comprised of latex, the entire pad being comprised of approximately 57.4% polyurethane foam and 42.6% latex by weight.

10. The pressure dispersing mattress system of claim 7, wherein two of the outer foam inserts are comprised of soft latex and one inner foam insert is comprised of extra soft latex, the entire pad being comprised of approximately 55% polyurethane foam and 45% latex by weight.

11. A pressure dispersing mattress system comprising:

an innerspring having a plurality of springs connected together in an array wherein the springs are arranged in rows and columns, each spring having a body with a first end and a second end, the body of each spring being generally cylindrical and having a longitudinal axis and an outer diameter, the springs being spaced apart in the rows and columns and connected together in a spaced apart arrangement with each spring being spaced from each spring in the array;

a first layer insulator pad positioned upon a supporting surface formed by the innerspring, a second layer positioned on top of the first layer, the second layer containing at least one polyurethane or latex foam pad, a pressure dispersion pad positioned on top of the second layer, and at least one additional layer positioned on top of the pressure dispersion pad;

the pressure dispersion pad comprising a base support pad, seven distinct zones or areas of support being integral and coextensive with each other and extending transversely and being arrayed form a head of said pressure dispersion pad to a foot of said pressure dispersion pad, wherein four zones are part of the base support pad and three foam inserts are made from latex, visco, NuForm, or a combination thereof, to form an additional three zones, the three foam inserts having a planar top and bottom surface that are placed in three predefined countersunk cut-outs in the base support pad;

at least one foam dampening insert engaged with the innerspring, the at least one foam dampening insert having a central core which fits between the bodies of adjacent springs, and a first segment which extends from the central core and into an opening region of a first spring to at least partially intersect a longitudinal axis of the first spring, a second segment which extends from the central core and into an opening region of a second spring which is adjacent to the first spring and to at least partially intersect a longitudinal axis of the second spring, a third segment which extends in the first direction from the central core and into an opening region of the first spring to at least partially intersect a longitudinal axis of the first spring, a fourth segment which extends in the second direction from the central core and into an opening region of the second spring to at least partially intersect a longitudinal axis of the second spring, and a fifth segment which extends in the first direction from the central core and into an opening region of the first spring to at least partially intersect a longitudinal axis of the first spring, each segment of the at least one foam dampening insert being located at a different elevation than every other segment of the at least one foam dampening insert.

12. The pressure dispersion mattress system of claim 11 further comprising four foam dampening inserts engaged with the innerspring are placed within the bodies of adjacent springs and located proximate to seams of the inner five adjacent zones which are comprised of different types of materials.

13. The pressure dispersing mattress system of claim 11, wherein the pressure dispersion pad comprises inserts made of material selected from the group of latex, visco, and NuForm.

14. The pressure dispersing mattress system of claim 11, wherein the pressure dispersion pad inserts comprise two different materials selected from the group of: latex, visco, and NuForm.

15. The pressure dispersion mattress system of claim 11 in combination with a foundation which is located underneath and proximate to the innerspring of the pressure dispersing mattress system.

16. The pressure dispersing mattress system of claim 1, further comprising four foam dampening inserts located proximate to seams of the inner five adjacent.

17. The pressure dispersing mattress system of claim 1 in combination with a foundation which is located underneath and proximate to the innerspring of the pressure dispersing mattress system.

18. The pressure dispersing mattress system of claim 1 further comprising at least one insulator pad located between the innerspring and the base support pad.

19. The pressure dispersing mattress system of claim 18 further comprising a pillow top located between the at least one insulator pad and the base support pad.

* * * * *